US005713231A

United States Patent [19]

Shen

[11] Patent Number: 5,713,231

[45] Date of Patent: Feb. 3, 1998

[54] PROTECTIVE COVER FOR DOUBLE-SIDED TYPE AUXILIARY LOCKS

[76] Inventor: Mu-lin Shen, No. 32, Lane 76, Sec. 5, Fu-an Rd., Tainan, Taiwan

[21] Appl. No.: 666,035

[22] Filed: Jun. 19, 1996

[51] Int. Cl.[6] ..... E05B 9/08

[52] U.S. Cl. ..... 70/370; 70/417; 70/449

[58] Field of Search ..... 70/370, 381, 417, 70/447–449, 451, 454, 452, 455

[56] References Cited

U.S. PATENT DOCUMENTS 4,073,172 2/1978 Schlage ..... 70/370
5,010,749 4/1991 Lin ..... 70/449
5,186,030 2/1993 Lin ..... 70/449
5,216,910 6/1993 Lin ..... 70/370

*Primary Examiner*—Rodney M. Lindsey
*Assistant Examiner*—Tuyet-Phuong Pham
*Attorney, Agent, or Firm*—Townsend and Townsend and Crew LLP

[57] ABSTRACT

An auxiliary lock includes a dead bolt, an interior lock assembly and an exterior lock assembly respectively mounted on two sides of a door. Each of the interior lock assembly and the exterior lock assembly includes a housing, a positioning seat, a lock core seat, and a lock core. A pair of bolts is provided to secure the interior lock assembly and the exterior lock assembly together. A protective cover is mounted to an enlarged end face of the lock core seat of the inner lock assembly to shield bolt heads of the bolts.

2 Claims, 4 Drawing Sheets

FIG.6
PRIOR ART
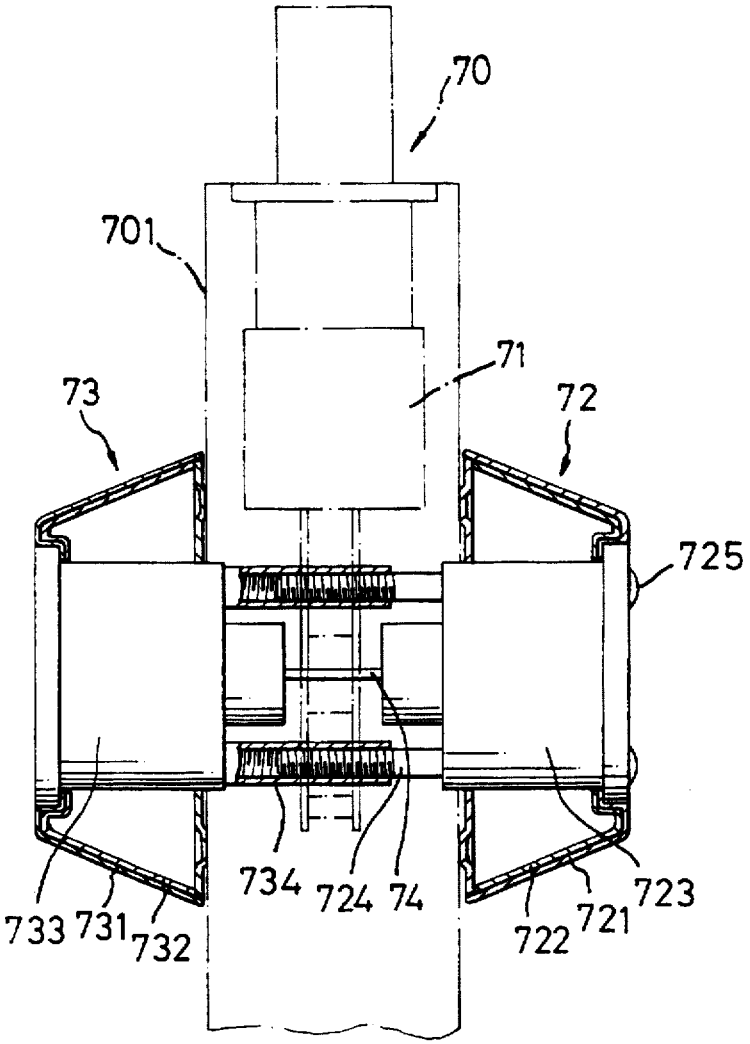
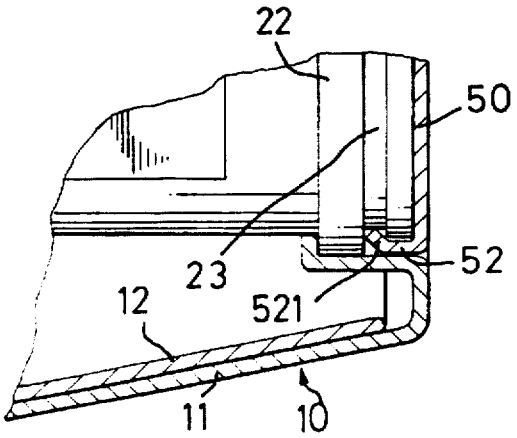
FIG.5

PROTECTIVE COVER FOR DOUBLE-SIDED TYPE AUXILIARY LOCKS

BACKGROUND OF THE INVENTION

1. Field of the Invention

The present invention relates to a protective cover for double-sided auxiliary locks.

2. Description of the Related Art

Locks play an important role in protecting life and property and a wide variety of them have been developed. Auxiliary locks provide additional security for doors which already have locks mounted thereon and include many types, e.g., "blank plate type" in which the auxiliary lock can be locked or unlocked by a key from outside only, "one-sided type" in which the auxiliary lock can be locked or unlocked by a key from outside and by a thumbturn on the inside, "double-sided type" in which the auxiliary lock can be locked or unlocked by a key from either side, etc.

FIG. 6 of the drawings illustrates a double-sided type auxiliary lock 70 which includes a dead bolt 71, an interior lock assembly 72 and an exterior lock assembly 73 respectively mounted on two sides of a door 701 that can be locked or unlocked by a key from either side. Each of the interior lock assembly 72 and the exterior lock assembly includes a housing 721, 731, a positioning seat 722, 732 mounted in the housing 721, 731, a lock core seat 723, 733 mounted in the positioning seat 722, 732, and a lock core (not shown) mounted in the lock core seat 723. The lock cores are interconnected by a tail piece 74 which extends across the dead bolt 71. In addition, a pair of studs 734 project from an inner side of the lock core, while a pair of bolts 724 extend through an end face of the lock core seat 723 so as to be received in screw holes defined in the studs 734.

The illustrated double-sided auxiliary lock is convenient for users to lock or unlock it from either side with a proper key, yet bolt heads 725 of the bolts 724 are exposed on the end face of the lock core seat 723 and thus can be removed by screwdrivers to detach the auxiliary lock. This problem can be ignored if the auxiliary lock is mounted in a house, as the bolt heads 725 are in the inner side of the house. Yet the problem cannot be ignored if the auxiliary lock is mounted at a place where there is no obvious distinction between interior and exterior. Thus, the auxiliary lock might be detached from the side where the bolt heads 725 are accessible. A further drawback of the auxiliary lock is that the exposed bolt heads 725 tend to rust and thus adversely affect the overall look of the auxiliary lock.

The present invention is intended to provide an improved auxiliary lock to solve these problem.

SUMMARY OF THE INVENTION

It is an object of the present invention to provide an auxiliary lock having a protective cover to shield the bolt heads thereof to prevent unauthorized entrance and to provide ornamentation.

An auxiliary lock in accordance with the present invention comprises a dead bolt, an interior lock assembly and an exterior lock, assembly respectively, mounted on two sides of a door that can be locked or unlocked by a key from either side. Both the interior lock assembly and the exterior lock assembly include a housing, a positioning seat mounted in the housing, a lock core seat mounted in the positioning seat and having an enlarged end face, and a lock core mounted in the lock core seat. The lock cores are interconnected by a tail piece which extends across the dead bolt. A pair of studs project from an inner side of the positioning seat of the exterior lock assembly. A pair of bolts extend through the enlarged end face of the lock core seat of the inner lock assembly and are respectively received in the studs of the exterior lock assembly.

The lock core seat of the interior lock assembly further includes a compartment defined therein for receiving the lock core and the enlarged end face thereof includes an opening corresponding to a sectional contour of the lock core. A pair of first screw holes through which the bolts respectively extend are defined in the enlarged end face and longitudinally extend through the lock core seat.

An inner end of the positioning seat of the interior lock assembly further includes a pair of second screw holes through which the bolts respectively extend. A protective cover is mounted to the enlarged end face of the lock core seat of the interior lock assembly to shield bolt heads of the bolts. The protective cover includes an opening corresponding to a sectional contour of the compartment without interfering with operation of the lock core.

In a preferred embodiment of the invention, the enlarged end face of the lock core seat of the interior lock assembly includes an annular groove defined along an outer periphery thereof, and the protective cover includes a peripheral flange mounted around the enlarged end face of the lock core seat, and a plurality of arcuate protrusions projecting from the peripheral flange and being received in the annular groove in the lock core seat of the interior lock assembly.

The enlarged end face of the lock core seat of the interior lock assembly further includes a second annular groove defined in an inner periphery thereof and in front of the compartment for access to a periphery defining the second opening of the protective cover after removal of the lock core for maintenance and/or replacement.

Other objects, advantages, and novel features of the invention will become more apparent from the following detailed description when taken in conjunction with the accompanying drawings.

BRIEF DESCRIPTION OF THE DRAWINGS

FIG. 5 is an enlarged fragmentary sectional view showing engagement of a protective cover to the inner lock assembly; and FIG. 6 is a schematic view illustrating a door having a conventional double-sided auxiliary lock mounted thereon.

DESCRIPTION OF THE PREFERRED EMBODIMENT

Figure 1:
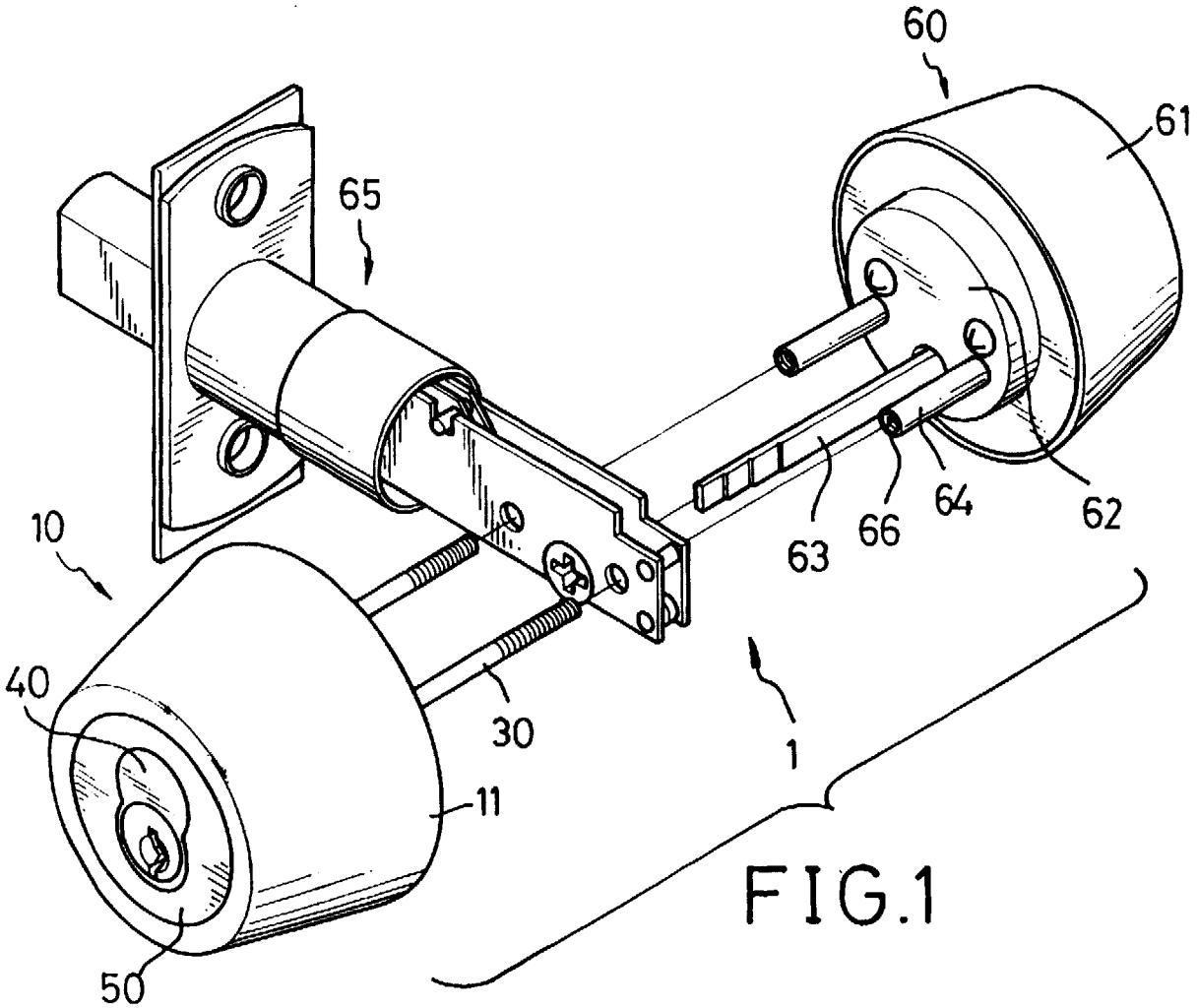
FIG. 1 is an exploded perspective view of a double-sided auxiliary lock in accordance with the present invention.

Referring now to FIGS. 1 to 5 and initially to FIG. 1, a double-sided type auxiliary lock in accordance with the present invention is designated by reference numeral "1" and includes a dead bolt 65, an interior lock assembly 10 and an exterior lock assembly 60 respectively mounted on two sides of a door 2 (see FIG. 3) and can be locked or unlocked by a key from either side. Still referring to FIG. 1 and further to FIG. 2, the interior lock assembly 10 and the exterior lock assembly 60 are substantially symmetric (therefore detailed structure of the exterior lock assembly 60 is not redundantly illustrated) and each of which includes a housing 11, 61, a positioning seat 12, 62 mounted in the housing 11, 61, a lock core seat 20 mounted in the positioning seat 12, and a changeable lock core 40 removably mounted in the lock core seat 20. The lock cores 40 are interconnected by a tail piece 63 which extends across the dead bolt 65. In addition, a pair of studs 64 project from a closed inner side of the positioning seat 62, while a pair of bolts 30 extend through an enlarged end face 22 of the lock core seat 20 so as to be received in screw holes 66 defined in the studs 64.

Figure 2:
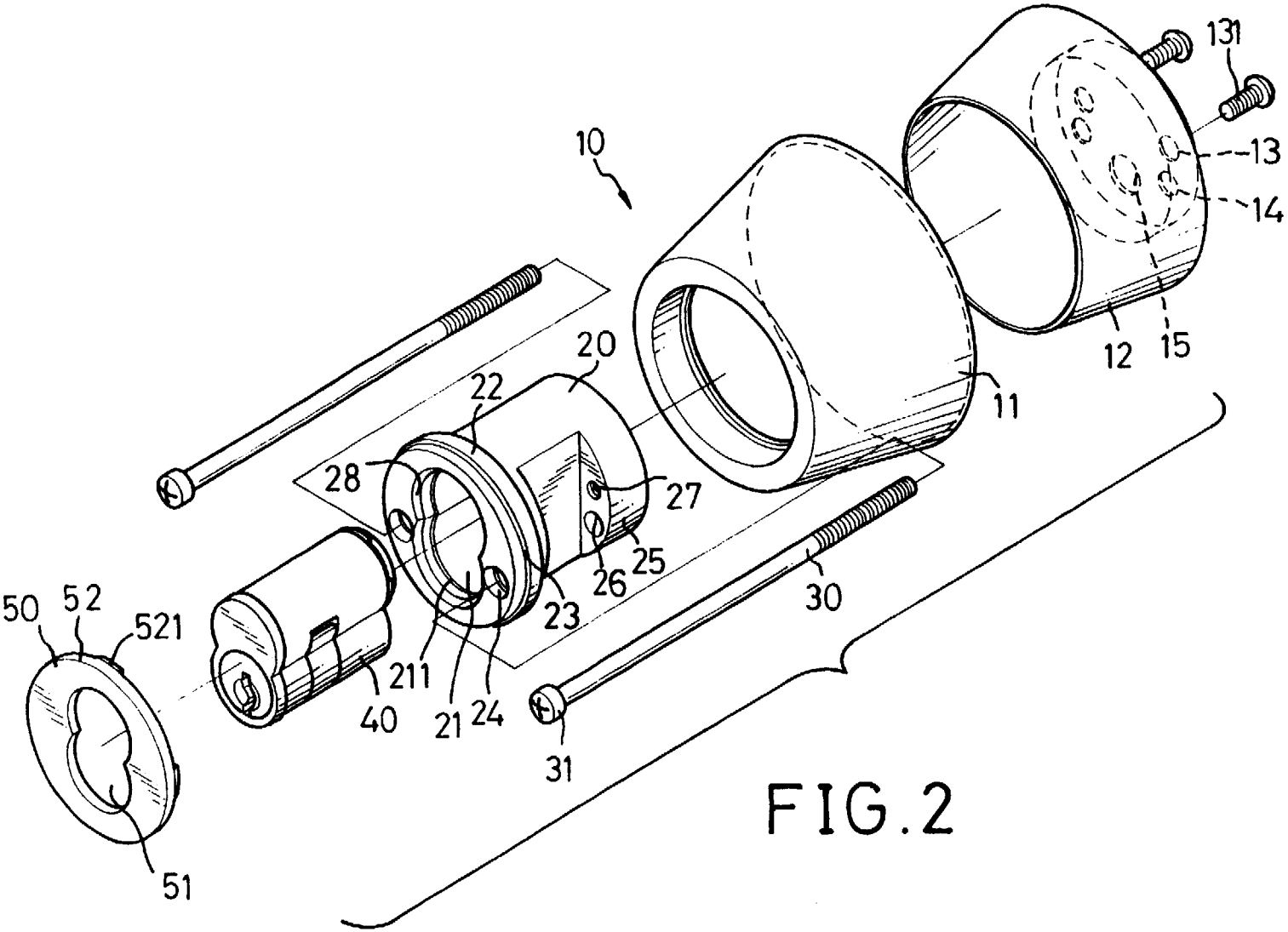
FIG. 2 is an exploded perspective view of an inner lock assembly of the double-sided auxiliary lock in accordance with the present invention.
Figure 4:
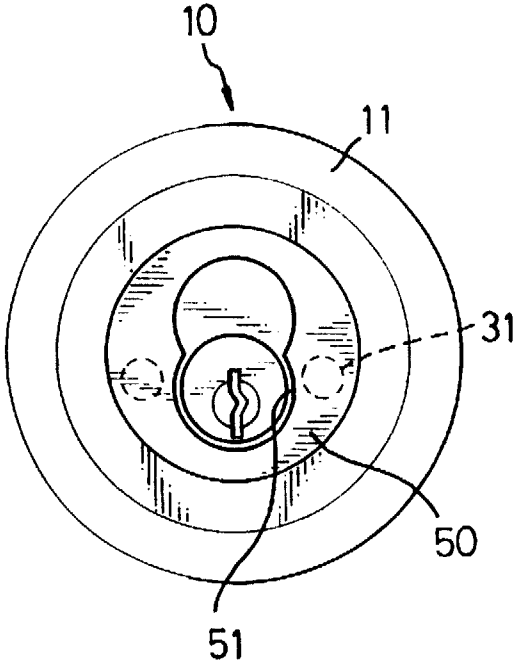
FIG. 4 is an end view of the auxiliary lock in accordance with the present invention.

Referring to FIG. 2, the interior lock core seat 20 includes a compartment 21 defined therein for receiving the lock core 40, and the enlarged end face 22 thereof includes an opening 28 corresponding to a sectional contour of the lock core 40. A pair of first screw holes 24 are defined in the enlarged end face 22 and longitudinally extend through the lock core seat 12. In this embodiment, a mediate portion of the lock core seat 20 is partially cut out and a pair of corresponding screw holes 26 are defined in a rear end 25 of the lock core seat 20.

Still referring to FIG. 2, a closed end of the positioning seat 12 includes a pair of second screw holes 14 through which the bolts 30 respectively extend and a pair of third screw holes 13 through which screws 131 are extended to be received in screw holes 27 defined in the rear end 25 of the lock core seat 20 for securing the inner lock core seat 20 in position. A further hole 15 is defined in the closed end of the positioning seat 12, thereby allowing the tail piece 63 to extend therethrough.

Figure 3:
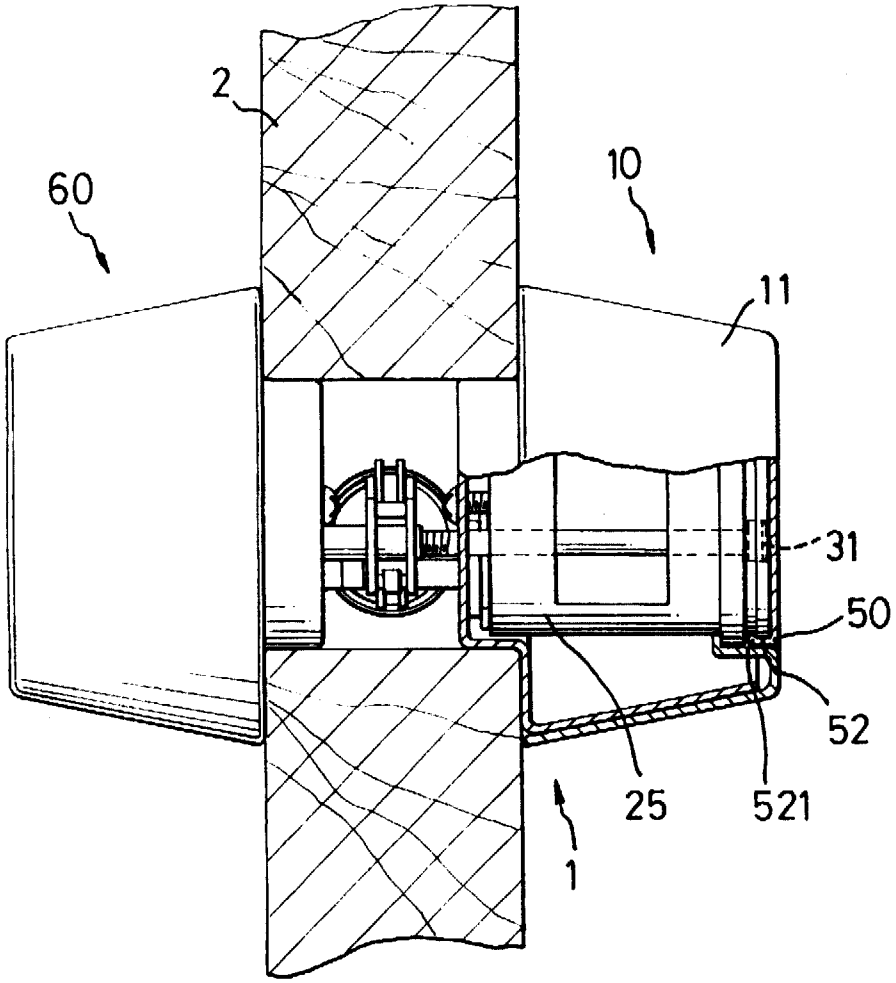
FIG. 3 is a side elevational view, partially sectioned and partially cut away, illustrating a door having the double-sided auxiliary lock mounted thereon.

Still referring to FIG. 2, the enlarged end face 22 of the lock core seat 20 includes an annular groove 23 defined along an outer periphery thereof. A protective cover 50 is mounted to shield bolt heads 31 of the bolts 30 extending in the first screw holes 24 and includes a peripheral flange 52 from which a plurality of discontinuous arcuate protrusions 521 angularly project from the peripheral flange such that each protrusion forms an obtuse angle with respect to the flange. Referring to FIGS. 3 and 5, when mounting the protective cover 50 to the lock core seat 20, the arcuate protrusions 521 may slightly bend outwardly and then slide into and thus be received in the annular groove 23 of the lock core seat 20, thereby providing a secure positioning effect. As clearly shown in FIG. 5, the peripheral flange 52 is mounted around the end face 22 of the lock core seat 20. The protective cover 50 includes an opening 51 which conforms to a sectional contour of the compartment 21 without interfering with operation of the lock core 40. Accordingly, the outer appearance of the inner lock assembly 10 and the outer lock assembly 60 are identical so that potential burglars cannot identify the side on which the bolt heads 31 are located.

Referring back to FIG. 2, the end face 22 further includes a second annular groove 211 defined in an inner periphery thereof and in front of the compartment 21 for access to a periphery defining the opening 51 of the protective cover 50. If maintenance or replacement is required, after removal of the lock core 40, a sharp tool may be inserted into the second annular groove 211 to reach the periphery defining the opening 51 of the protective cover 50, thereby removing the protective cover 50 for maintenance and/or replacement.

Accordingly, the present invention provides a double-sided auxiliary lock which prevents unauthorized access to the bolt heads, provides an ornamentation, and prevents the bolt heads from being rusted.

Although the invention has been explained in relation to its preferred embodiment, it is to be understood that many other possible modifications and variations can be made without departing from the spirit and scope of the invention as hereinafter claimed.

What is claimed is:

1. An auxiliary lock comprising:

a dead bolt, an interior lock assembly and an exterior lock assembly respectively mounted on two sides of a door and that can be locked or unlocked by a key from either side, each of the interior lock assembly and the exterior lock assembly including a housing, a positioning seat mounted in the housing and having an inner side, a lock core seat mounted in the positioning seat and having an enlarged end face, and a lock core mounted in the lock core seat, the lock cores being interconnected by a tail piece which extends across the dead bolt, a pair of studs projecting from the inner side of the positioning seat of the exterior lock assembly, and a pair of bolts extending through the enlarged end face of the lock core seat of the inner lock assembly and being respectively received in the studs of the exterior lock assembly, and each said bolt having a bolt head;

the lock core seat of the interior lock assembly further including a compartment defined therein for receiving the lock core and the enlarged end face thereof including an opening corresponding to a sectional contour of the lock core, and a pair of first screw holes being defined in the enlarged end face and longitudinally extending through the lock core seat and through which the bolts respectively extend;

an inner end of the positioning seat of the interior lock assembly further including a pair of second screw holes through which the bolts respectively extend; and a protective cover mounted to the enlarged end face of the lock core seat of the interior lock assembly to shield bolt heads of the bolts, the protective cover including a second opening which conforms to a sectional contour of the compartment without interfering with operation of the lock core, wherein the enlarged end face of the lock core seat of the interior lock assembly includes an annular groove defined along an outer periphery thereof, and the protective cover includes a peripheral flange mounted around the enlarged end face of the lock core seat of the interior lock assembly, a plurality of discontinuous arcuate protrusions protecting angularly from the peripheral flange such that each protrusion forms an obtuse angle with respect to the flange and being received in the annular groove in the lock core seat of the inner lock assembly.

2. The auxiliary lock assembly as claimed in claim 1, wherein the enlarged end face of the lock core seat of the interior lock assembly further includes a second annular groove defined in an inner periphery thereof and in front of the compartment for access to a periphery defining the second opening of the protective cover after removal of the lock core.

* * * * *